US008105698B2

(12) United States Patent
Manabe et al.

(10) Patent No.: US 8,105,698 B2
(45) Date of Patent: Jan. 31, 2012

(54) PLATED STEEL WIRE FOR PARALLEL WIRE STRAND (PWS) WITH EXCELLENT TWIST PROPERTIES

(75) Inventors: Toshiyuki Manabe, Tokyo (JP); Shingo Yamasaki, Tokyo (JP); Seiki Nishida, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 121 days.

(21) Appl. No.: 12/293,067

(22) PCT Filed: Dec. 10, 2007

(86) PCT No.: PCT/JP2007/073770

§ 371 (c)(1),
(2), (4) Date: Sep. 15, 2008

(87) PCT Pub. No.: WO2008/093466

PCT Pub. Date: Aug. 7, 2008

(65) Prior Publication Data

US 2010/0239884 A1 Sep. 23, 2010

(30) Foreign Application Priority Data

Jan. 31, 2007 (JP) ..... 2007-022412

(51) Int. Cl.
*B32B 15/04* (2006.01)
*B32B 15/18* (2006.01)
*B32B 15/20* (2006.01)

(52) U.S. Cl. ..... 428/659; 428/364; 428/378; 428/389

(58) Field of Classification Search ..... 428/659, 428/658, 681, 684, 357, 364, 378, 389, 401, 428/213, 215, 219, 220
See application file for complete search history.

(56) References Cited

U.S. PATENT DOCUMENTS

| | | | | |
|---|---|---|---|---|
| 5,211,772 | A | 5/1993 | Ashida et al. | |
| 2006/0048864 | A1 * | 3/2006 | Nagao et al. | 148/320 |
| 2009/0151824 | A1 * | 6/2009 | Yamasaki et al. | 148/598 |
| 2009/0229711 | A1 * | 9/2009 | Yamasaki et al. | 148/505 |

FOREIGN PATENT DOCUMENTS

JP 6-235054 8/1994

(Continued)

OTHER PUBLICATIONS

Machine Translation, Tarui et al., JP 2003-096544, Apr. 2003.*

(Continued)

*Primary Examiner* — Michael Lavilla
(74) *Attorney, Agent, or Firm* — Dorsey & Whitney LLP

(57) ABSTRACT

A plated steel wire for PWS with excellent twist properties contains, in terms of mass %, 0.8 to 1.1% of C, 0.8 to 1.3% of Si, 0.3 to 0.8% of Mn, 0.001 to 0.006% of N, and 0.0004 to 0.0060% of B, where a quantity of solid-solubilized B is at least 0.0002%, also contains either one or both of 0.005 to 0.1% of Al and 0.005 to 0.1% of Ti, and contains as the remainder, Fe and unavoidable impurities, wherein an area fraction of non-pearlite structures in a region from a surface layer down to a depth of 50 μm is not more than 10%, an area fraction of non-pearlite structures within an entire cross-section is not more than 5%, and a surface of the steel wire is galvanized with a plating quantity within a range from 300 to 500 g/m$^2$.

3 Claims, 1 Drawing Sheet

FOREIGN PATENT DOCUMENTS

Figure 1:
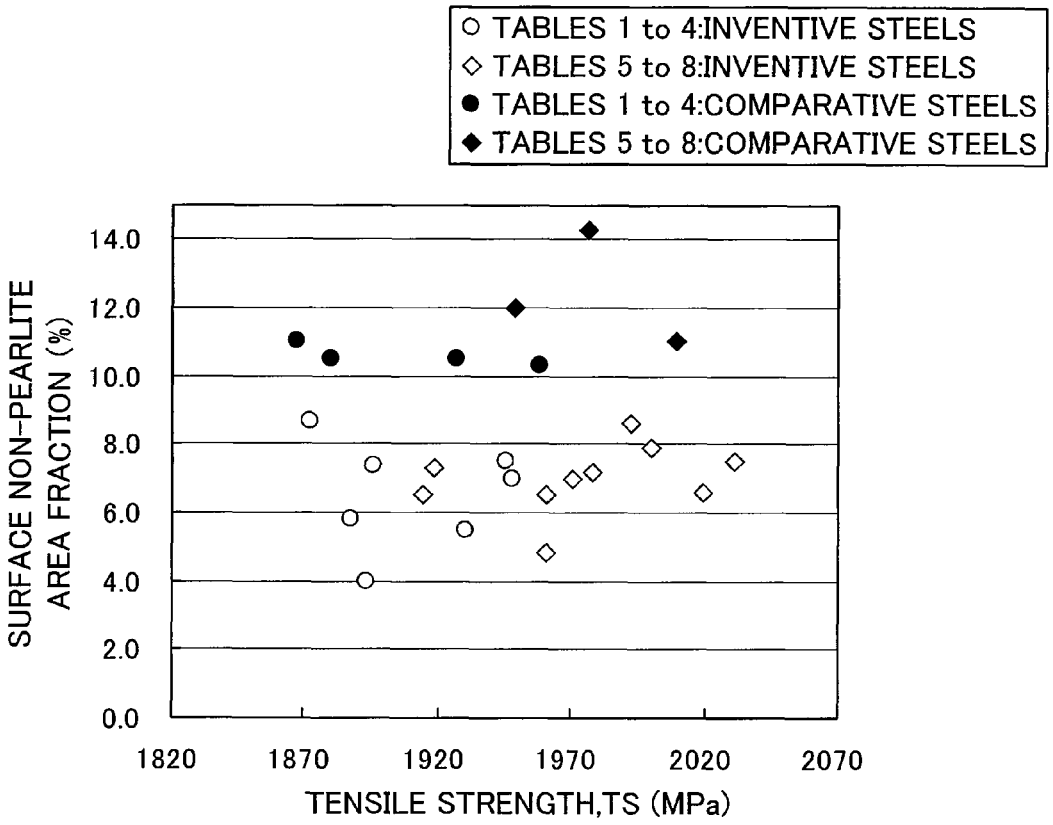

| | | | |
|---|---|---|---|
| JP | 8-53737 | | 2/1996 |
| JP | 2609387 | | 2/1997 |
| JP | 2001-131697 | | 5/2001 |
| JP | 2003-96544 | | 4/2003 |
| JP | 2003-328077 | | 11/2003 |
| JP | 2005-232549 | | 9/2005 |
| WO | WO 2007/001054 | * | 1/2007 |
| WO | WO 2007/001057 | | 1/2007 |

OTHER PUBLICATIONS

Machine Translation, Ochiai et al., JP 06-235054, Aug. 1994.*

English language International Search Report for International Application No. PCT/JP2007/073770 filed Dec. 10, 2007, (Feb. 2008).

* cited by examiner

PLATED STEEL WIRE FOR PARALLEL WIRE STRAND (PWS) WITH EXCELLENT TWIST PROPERTIES

CROSS-REFERENCE TO RELATED APPLICATION(S)

This application is a national stage application of PCT Application No. PCT/JP2007/073700 which was filed on Dec. 10, 2007, and published on Aug. 7, 2008 as International Publication No. WO 2008/093466 (the "International Application"). This application claims priority from the International Application pursuant to 35 U.S.C. §365, and from Japanese Patent Application No. 2007-022412 filed Jan. 31, 2007, under 35 U.S.C. §119. The disclosures of the above-referenced applications are incorporated herein by reference in their entities.

FIELD OF THE INVENTION

The present invention relates to a plated steel wire for a parallel wire strand ("PWS") can exhibit excellent twist properties and may be used for suspending bridges, etc., and also relates to a method for manufacturing such exemplary plated steel wire.

BACKGROUND INFORMATION

In a conventional production of high-strength plated steel wire for PWS, hot-rolled wire rods can be subjected to a patenting treatment as necessary, and can then be drawn out to form steel wires having a predetermined diameter, and subsequently galvanized to impart corrosion resistance. This series of treatments may be required, in conventional methods, to generate a strength of $TS \geqq 2192-61 \times d$ (wherein, TS represents the tensile strength (MPa) and d represents the wire diameter (mm)), and possibly ensure satisfactory ductility performance, which can be typically evaluated by the reduction in area at breakage.

In order to satisfy the above requirements, attempts have been made to improve the drawing workability of high carbon wire rods, either by controlling segregations or microstructures within the rod material, or by including a specific element within the rod material.

A reduction in area for patented wired rods can depend on the grain size of austenite, and the reduction in area may be improved by reducing the grain size of the austenite. Accordingly, attempts have been made to reduce the austenite grain size by using carbides or nitrides of Nb, Ti or B or the like as pinning particles.

For example, a wire rod has been proposed in which one or more elements selected from the group consisting of 0.01 to 0.1% by weight of Nb, 0.05 to 0.1% by weight of Zr, and 0.02 to 0.5% by weight of Mo are added as constituent elements to a high carbon wire rod, as described in Japanese Patent No. 2,609,387.

Furthermore, a wire rod in which the austenite grain size can be reduced by adding NbC to a high carbon wire rod has also been proposed, as described in Japanese Unexamined Patent Application, First Publication No. 2001-131697.

In the case of the wire rod described Japanese Patent No. 2,609,387, the constituent elements described herein above can be added to produce a composition that yields increased ductility for the steel wire. However, in the wire rod described in Japanese Patent No. 2,609,387, because each of the added constituent elements is likely expensive, the production costs tend to increase.

In the wire rod described in Japanese Unexamined Patent Application, First Publication No. 2001-131697, the drawing workability can be improved by adding NbC as pinning particles. However, in the wire rod described in Japanese Unexamined Patent Application, First Publication No. 2001-131697, because each of the added constituent elements may be expensive, the production costs tend to increase. Furthermore, Nb may form coarse carbides or nitrides, and Ti may form coarse oxides, and such compounds may act as the origins of breakages, likely causing a deterioration in the drawability.

Increasing the quantities of C and Si within the wire rod components can be one the most economical and effective ways of increasing the strength of high carbon steel wire. However, as the Si content is increased, ferrite precipitation is likely accelerated, and cementite precipitation is suppressed. As a result, even in the case of a steel having a hypereutectoid composition with a C content that exceeds 0.8%, when the steel is cooled from the austenite region during the patenting treatment, proeutectoid ferrites tend to precipitate in the form of platelets along the austenite grain boundaries.

Moreover, because addition of Si likely causes an increase in the pearlite eutectic temperature, a supercooled composition (such as degenerate pearlite or bainite) tends to be generated within the temperature range of 480 to 650° C. that can be typically employed during patenting. As a result, the reduction in area at breakage of the wire rod after patenting treatment tends to decrease, the ductility tends to deteriorate, and the frequency of wire breakages during the drawing process tends to increase, likely causing a reduction in the productivity and yield.

Accordingly, there may be a need to address and/or overcome at least some of the deficiencies described herein above.

SUMMARY OF EXEMPLARY EMBODIMENTS OF THE INVENTION

Exemplary embodiments of the present invention has been made in view of the above circumstances. One of the objects of the exemplary embodiments is to providing a plated steel wire that may be inexpensive, that can be manufactured with a high yield, and which can exhibit a high reduction in area and excellent twist properties. Another one of the objects can be to provide a method for manufacturing such a plated steel wire.

As a result of thorough investigation aimed at achieving the above-described exemplary objects, e.g., by ensuring the existence, within the austenite prior to patenting treatment, of solid-solubilized B in a quantity corresponding with the quantities of C and Si, the driving forces for cementite precipitation and ferrite precipitation can be balanced, and a high carbon pearlite wire rod having a high reduction in area and minimal non-pearlite structures may be obtained, thereby likely achieving a combination of a high degree of strength and excellent workability due to superior drawability.

According to one exemplary embodiment of the present invention, a plated steel wire for PWS with excellent twist properties can be provided which may comprise at least one portion that may include, in terms of mass %: 0.8 to 1.1% of C, 0.8 to 1.3% of Si, 0.3 to 0.8% of Mn, 0.001 to 0.006% of N, and 0.0004 to 0.0060% of B, where a quantity of solid-solubilized Bis at least 0.0002%, and can also include either one or both of 0.005 to 0.1% of Al and 0.005 to 0.1% of Ti, with, as the remainder, Fe and unavoidable impurities. For example, an area fraction of non-pearlite structures in a region from a surface layer down to a depth of 50 μm can be not more than 10%, an area fraction of non-pearlite structures within an entire cross-section may be not more than 5%, and a surface of the steel wire can be galvanized with a plating quantity within a range from 300 to 500 g/m$^2$.

Further, such exemplary plated steel wire may also include, in terms of mass %, one or more of: more than 0% but not more than 0.5% of Cr, more than 0% but not more than 0.5% of Ni, more than 0% but not more than 0.5% of Co, more than 0% but not more than 0.5% of V, more than 0% but not more than 0.2% of Cu, more than 0% but not more than 0.2% of Mo, more than 0% but not more than 0.2% of W, more than 0% but not more than 0.1% of Nb, and more than 0% but not more than 0.05% of Zr.

The plated steel wire may also have a wire diameter within a range from 4.5 to 7.5 mm, and a tensile strength that satisfies: TS≧2192−61×d (wherein, TS represents the tensile strength (MPa) and d represents the wire diameter (mm)).

According to an exemplary embodiment of a method for manufacturing a plated steel wire for PWS with excellent twist properties according to the present invention, the following procedures can be performed: heating, within an oven at 1,000 to 1,200° C., a slab including, in terms of mass %, 0.8 to 1.1% of C, 0.8 to 1.3% of Si, 0.3 to 0.8% of Mn, 0.001 to 0.006% of N, and 0.0004 to 0.0060% of B, further including either one or both of 0.005 to 0.1% of Al and 0.005 to 0.1% of Ti, with as the remainder, Fe and unavoidable impurities; subjecting the slab to descaling immediately after extraction from the oven, and then subjecting the slab to rough rolling and finish rolling, thereby forming a wire rod having a diameter of 9 to 16 mm; cooling the wire rod at a final rolling stand after completion of rolling; then coiling the wire rod at a rod temperature within a range from 800 to 950° C.; subsequently, within a time t1 (seconds) represented by a formula shown below passes; immersing the wire rod in a molten salt at a temperature within a range from 525 to 600° C. so as to effect a patenting treatment, and then subjecting a resulting wire rod to cold working at a true strain, represented by a formula (2) shown below, of 1.2 to 1.9. Thus, a steel wire is formed in which an area fraction of non-pearlite structures in a region from a surface layer down to a depth of 50 μm is not more than 10%, and an area fraction of non-pearlite structures within an entire cross-section is not more than 5%; and subsequently subjecting the steel wire to galvanizing with a plating quantity within a range from 300 to 500 g/m$^2$.

For example, formula (1) can be as follows:

$$t1=0.0013\times(Tr-815)^2+7\times(B-0.0003)/(N-Ti/3.41-B+0.0003) \quad (1)$$

(whereas, in formula (1), Tr is a coiling temperature for the wire rod, and furthermore, t1=40 seconds if either (N—Ti/3.41−B+0.0003) is zero or less, or if a calculated value of t1 exceeds 40 seconds)

Further, formula (2) can be as follows:

$$\epsilon=2\cdot\ln(d_0/d) \quad (2)$$

(whereas, in formula (2), $d_0$ represents a diameter (mm) of the wire rod prior to cold working, d represents a diameter (mm) of the steel wire after cold working, and ln represents a natural logarithm)

In the above exemplary embodiment of the method, after subjecting the wire rod to rolling and subsequent cooling at the final rolling stand, a temperature of the wire rod may be initially cooled to a temperature of not more than 200° C. using a molten salt, Stelmor cooling, or atmospheric cooling, and after completion of a transformation, the wire rod may be reheated to a temperature of at least 950° C. to austenitize, and may be then immersed in molten lead at 525 to 600° C. so as to effect a patenting treatment.

According to another exemplary embodiment of a method for manufacturing a plated steel wire for PWS with excellent twist properties according to the present invention, it is possible to perform cold working at a true strain, represented by a formula (3) shown below, of 1.2 to 1.9 on a wire rod including, in terms of mass %, 0.8 to 1.1% of C, 0.8 to 1.3% of Si, 0.3 to 0.8% of Mn, 0.001 to 0.006% of N, and 0.0004 to 0.0060% of B, where a quantity of solid-solubilized B is at least 0.0002%, further including either one or both of 0.005 to 0.1% of Al and 0.005 to 0.1% of Ti, and containing as the remainder, Fe and unavoidable impurities. The wire rod can have an area fraction of non-pearlite structures in a region from a surface layer down to a depth of 100 μm that is not more than 10%, an area fraction of non-pearlite structures within an entire cross-section that is not more than 5%, and a tensile strength that is at least 1,250 MPa. Thereby, a steel wire is formed in which an area fraction of non-pearlite structures in a region from a surface layer down to a depth of 50 μm is not more than 10%, and an area fraction of non-pearlite structures within an entire cross-section is not more than 5%; and subsequently subjecting the steel wire. The steel wire is subsequently subjected to galvanizing with a plating quantity within a range from 300 to 500 g/m$^2$.

For example, formula (3) can be as follows:

$$\epsilon=2\cdot\ln(d_0/d) \quad (3)$$

(whereas, in formula (3), $d_0$ represents a diameter (mm) of the wire rod prior to cold working, d represents a diameter (mm) of the steel wire after cold working, and ln represents a natural logarithm).

The cold working used for processing the wire rod into steel wire can include not only common wire drawing processes using hole dies, but also cold rolling processes using roller dies.

Furthermore, the expression "excellent twist properties" used in the description of the present invention can mean, but not limited to, that when a twist test is conducted on the steel wire or plated steel wire, breakages caused by "localized twisting" in which the twisting is concentrated within a specific location, and "delamination" in which longitudinal cracking occurs after commencement of twisting do not occur.

In accordance with an exemplary embodiment of a plated steel wire for PWS with excellent twist properties and coiling properties according to the present invention, the steel wire can include at least one portion which can contain, in terms of mass %, 0.8 to 1.1% of C, 0.8 to 1.3% of Si, 0.3 to 0.8% of Mn, 0.001 to 0.006% of N, and 0.0004 to 0.0060% of B, where the quantity of solid-solubilized B is at least 0.0002%, further can include either one or both of 0.005 to 0.1% of Al and/or 0.005 to 0.05% of Ti, with the remainder, Fe and unavoidable impurities, and the tensile strength TS of the wire which can satisfy: TS≧2192−61×d (whereas TS represents the tensile strength (MPa) and d represents the wire diameter (mm)).

Furthermore, in the wire rod stage, e.g., the area fraction of non-pearlite structures including proeutectoid ferrites, degenerate pearlite, and bainite that tend to precipitate at the prior austenite grain boundaries may be at most 10% in the region from the surface layer down to a depth of 100 μm, and/or the area fraction of non-pearlite structures is not more than 5% in the entire cross-section from the surface layer through to the center of the wire rod, and the remainder of the wire rod can be composed of pearlite structures.

Moreover, in the steel wire stage after drawing, e.g., the area fraction of non-pearlite structures including proeutectoid ferrites, degenerate pearlite, and bainite that tend to precipitate at the prior austenite grain boundaries may be at most 10% in the region from the surface layer down to a depth of 50 μm, or the area fraction of non-pearlite structures is at most 5% in the entire cross-section from the surface layer through to the center of the steel wire, and the remainder of the steel wire can be composed of pearlite structures.

By setting the quantities of each of the components to the exemplary values listed above, and ensuring the existence, within the austenite prior to patenting treatment, of solid-solubilized B in a quantity corresponding with the quantities of C and Si, the driving forces for cementite precipitation and ferrite precipitation can be balanced, and the generation of non-pearlite structures can be suppressed. As a result, the ductility can be improved, and wire breakages during the drawing process can be prevented. Therefore, the productivity and the yield can be increased during the production of the plated steel wire for PWS.

Moreover, even in the case of a plated steel wire prepared by performing a plating treatment on a cold worked steel wire, because the wire contains mainly pearlite, and the area fraction of non-pearlite structures has been reduced, the plated steel wire still exhibits excellent twist properties These and other objects, features and advantages of the present invention will become apparent upon reading the following detailed description of embodiments of the invention, when taken in conjunction with the appended claims.

BRIEF DESCRIPTION OF THE DRAWING(S)

Further objects, features and advantages of the invention will become apparent from the following detailed description taken in conjunction with the accompanying FIGURE showing illustrative embodiment(s), result(s) and/or feature(s) of the exemplary embodiment(s) of the present invention, in which:

FIG. 1 is a graph showing an exemplary relationship between a surface non-pearlite area fraction and a tensile strength for exemplary embodiments of steels according to the present invention and comparative steels.

While the present invention will now be described in detail with reference to the FIGURES, it is done so in connection with the illustrative embodiments.

DETAILED DESCRIPTION OF THE EMBODIMENTS OF THE INVENTION

A detailed description of exemplary embodiments of a high-strength plated steel wire for PWS with excellent twist properties according to the present invention, and a method for manufacturing such a plated steel wire is provided herein below.

Exemplary Component Composition

Provided below are exemplary reasons for limiting the exemplary quantity of each component in a plated steel wire for PWS with excellent twist properties according to the exemplary embodiment of the present invention.

(C: 0.8 to 1.1 Mass %)

C is an element that is effective in increasing the tensile strength of the wire rod, and enhancing the work-hardening rate during drawing of the wire rod.

If the C content is less than 0.8%, then obtaining a high-strength wire rod with a tensile strength of 1,250 MPa or greater may be difficult, and the volume fraction of proeutectoid ferrites that precipitate at the austenite grain boundaries during cooling tends to increase; thereby, it is difficult to obtain a uniform pearlite structure. In contrast, if the C content is greater than 1.1%, then a proeutectoid cementite network may precipitate at the austenite grain boundaries during the patenting treatment, causing a dramatic deterioration in the drawing workability, the toughness, and the ductility. For these reasons, the C content is provided at a mass % value in the range from 0.8 to 1.1%.

(Si: 0.8 to 1.3 Mass %)

Si is an element that is effective in increasing the strength of the wire rod, and is also effective as a deoxidizing agent.

Provided the Si content is 0.8% or greater, the Si is concentrated at the ferrite/cementite interface during the pearlite transformation, and can have the effect of inhibiting dissolution of the lamellar cementite under the temperature conditions employed during the plating treatment, thereby likely suppressing reductions in the tensile strength and ductility. In contrast, if the quantity of added Si content is too high, then precipitation of proeutectoid ferrite may be accelerated even in a hypereutectoid steel, and the position of the transformation start nose during isothermal transformation tends to shift to a higher temperature, meaning the upper bainite structure fraction after patenting increases, likely making it difficult to obtain a uniform pearlite structure. In addition, the mechanical descaling properties also tend to deteriorate. For these reasons, the Si content is can be provided at a mass % value in the range from 0.8 to 1.3%.

(Mn: 0.3 to 0.8 Mass %)

Mn is an element that is effective as a deoxidizing and desulfurizing agent. Mn is also effective in improving hardenability and increasing the tensile strength after the patenting treatment. If the Mn content is less than 0.3%, then the above effects may be insufficient to achieve the desired increase in tensile strength. In contrast, if the Mn content can be greater than 0.8%, then Mn segregates within the central portion of the wire rod, and because bainites or martensites may be generated within this segregated portion, the drawing workability tends to deteriorate. For these reasons, the Mn content can be provided at a mass % value in the range from 0.3 to 0.8%.

(Al: 0.005 to 0.1 Mass %)

Al is an element that is effective as a deoxidizing agent. Furthermore, Al also has an effect of fixing N by forming nitrides, thereby inhibiting coarsening of the austenite grains and suppressing aging, as well as an effect of increasing the quantity of solid-solubilized B.

If the Al content is less than 0.005%, then the effect of the Al in fixing N may be difficult to obtain. In contrast, if the Al content is greater than 0.1%, then a large quantity of non-deformable alumina-based non-metallic inclusions may be generated, thereby lowering the ductility and drawability of the steel wire. Therefore, it may be preferred that the Al content is within the range of 0.005 to 0.1% by mass. If a quantity of Ti described below is added, then because Ti also has the effect of fixing N, it is possible to obtain the above effects without adding Al. Accordingly, it is not necessary to specify a lower limit for the Al content, and the Al content may be 0%.

(Ti: 0.005 to 0.1 Mass %)

Ti is an element that is effective as a deoxidizing agent. Furthermore, Ti may also have an effect of fixing N by forming nitrides, thereby inhibiting coarsening of the austenite grains and suppressing aging, as well as an effect of increasing the quantity of solid-solubilized B.

If the Ti content is less than 0.005%, then the effect of the Ti in fixing N can be difficult to obtain. In contrast, if the Ti content is greater than 0.1%, then the Ti precipitates within the austenite as coarse Ti carbides, lowering the ductility and drawability of the steel wire. For these reasons, the Ti content can be provided at a mass % value in the range from 0.005 to 0.1%.

(N: 0.001 to 0.006 Mass %)

N generates nitrides with Al, Ti and B, and has a function of preventing coarsening of the austenite grains during heating.

If the N content is less than 0.001%, then the above function may not be obtainable. In contrast, if the N content is too high, then the quantity of B nitrides generated can increase, and the quantity of solid-solubilized B within the austenite is likely lowered. For these exemplary reasons, the N content can be provided at a mass % value in the range from 0.001 to 0.006%.

(B: 0.0004 to 0.0060 Mass %)

When B exists within the austenite as solid-solubilized B, it is concentrated at the grain boundaries, and has the effect of suppressing the precipitation of proeutectoid ferrites and accelerating the precipitation of proeutectoid cementites. Accordingly, by adding B in a quantity determined in accordance with its balance with the quantities of C and Si, it is possible to suppress the generation of proeutectoid ferrite and bainite. On the other hand, because B forms nitrides, the B content should also be determined with due consideration of its balance with the quantity of N during the patenting treatment conducted in the wire rod production stage, in order to ensure a quantity of solid-solubilized B within the austenite that yields the above effects. If the B content is too high, then not only is the precipitation of proeutectoid cementites accelerated, but there is also the possibility of coarse carbides such as $Fe_{23}(C,B)_6$ being generated within the austenite, causing a deterioration in the drawability. Accordingly, in order to suppress proeutectoid ferrite and bainite, and obtain a wire rod having favorable drawing properties, the B content can be set within a range from 0.0004 to 0.0060%.

(Solid-Solubilized B: at Least 0.0002 Mass %)

In a high-strength plated steel wire for PWS according to the exemplary embodiments of the present invention, by ensuring a quantity of solid-solubilized B within the austenite prior to patenting that is in accordance with the quantities of C and Si, a high carbon pearlite wire rod having minimal non-pearlite structures and a high reduction in area can be obtained. Moreover, after cold working and plating treatment, a steel wire with excellent twist properties can be obtained. In order to achieve these effects, the quantity of solid-solubilized B should be at least 0.0002%.

Although there are no particular restrictions on the quantities of the impurities P and S, the quantity of each can be preferably to 0.02% or less.

The high-strength plated steel wire for PWS described in the exemplary embodiment of the present invention can include the above components in its basic composition, but one or more of the following selectively allowable additive elements may also be actively added for the purpose of improving the mechanical properties such as the strength, toughness and ductility.

(Cr: not More than 0.5 Mass % (but Excluding 0%))

Cr is an element that is effective for refining the cementite spacing of pearlite, as well as for improving the tensile strength of the wire rod or the work-hardening rate during drawing.

In order to ensure satisfactory manifestation of these effects, Cr can be preferably added in a quantity of at least 0.1%. In contrast, if the quantity of added Cr is too large, the transformation end time during patenting may be extended, supercooled structures such as martensites, bainites, and the like may be generated, and the mechanical descaling properties may deteriorate, and consequently the upper limit for the Cr content can be set to 0.5%.

(Ni: not More than 0.5 Mass % (but Excluding 0%))

Ni has the effects of increasing the drawing workability and the toughness of the wire rod. In order to ensure satisfactory manifestation of these effects, Ni is preferably added in a quantity of at least 0.1%. In contrast, if Ni is added in excess, then the transformation end time may be extended, and consequently the upper limit for the Ni content can be set to 0.5%.

(Co: not More than 0.5 Mass % (but Excluding 0%))

Co is an element that is effective in suppressing the precipitation of proeutectoid cementites during the patenting treatment. In order to ensure satisfactory manifestation of this effect, Co is preferably added in a quantity of at least 0.1%. In contrast, even if Co is added in excess, the above effect can become saturated and the production costs may become unjustifiable, and consequently the upper limit for the Co content can be set to 0.5%.

(V: not More than 0.5 Mass % (but Excluding 0%))

V is an element which, by forming fine carbonitrides within ferrites, suppresses coarsening of the austenite grain size during heating, and contributes to an increase in the strength of the steel after hot rolling. In order to ensure satisfactory manifestation of this effect, V is preferably added in a quantity of at least 0.05%. In contrast, if V is added in excess, then the quantity of carbonitrides generated becomes overly large, and the particle size of the carbonitrides likely also increases, and consequently the upper limit for the V content can be set to 0.5%.

(Cu: not More than 0.2 Mass % (but Excluding 0%))

Cu has the effect of enhancing the corrosion resistance of the steel wire. In order to ensure satisfactory manifestation of this type of effect, Cu is preferably added in a quantity of at least 0.1%. In contrast, if Cu is added in excess, then the Cu likely reacts with S, leading to the segregation of CuS at the austenite grain boundaries, and causing defects in the steel ingots or wire rods generated in the course of the wire rod production process. In order to prevent this type of adverse effect, the upper limit for the Cu content can be set to 0.2%.

(Mo: not More than 0.2 Mass % (but Excluding 0%))

Mo has the effect of enhancing the corrosion resistance of the steel wire. In order to ensure satisfactory manifestation of this effect, Mo is preferably added in a quantity of at least 0.1%. In contrast, if Mo is added in excess, then the transformation end time tends to be extended, and consequently the upper limit for the Mo content can be set to 0.2%.

(W: not More than 0.2 Mass % (but Excluding 0%))

W has the effect of enhancing the corrosion resistance of the steel wire. In order to ensure satisfactory manifestation of this effect, W is preferably added in a quantity of at least 0.1%. In contrast, if W is added in excess, then the transformation end time tends to be extended, and consequently the upper limit for the W content can be set to 0.2%.

(Nb: not More than 0.1 Mass % (but Excluding 0%))

Nb generates carbonitrides in a similar manner to Ti, thereby having the effect of inhibiting coarsening of the austenite grains during heating. In order to ensure satisfactory manifestation of this effect, Nb is preferably added in a quantity of at least 0.05%. In contrast, if Nb is added in excess, then the transformation end time tends to be extended, and consequently the upper limit for the Nb content can be set to 0.1%.

(Zr: not More than 0.05 Mass % (but Excluding 0%))

Zr generates carbonitrides in a similar manner to Ti, thereby having the effect of inhibiting coarsening of the austenite grains during heating, and also has the effect of enhancing the corrosion resistance. In order to ensure satisfactory manifestation of these effects, Zr is preferably added in a quantity of at least 0.001%. In contrast, if Zr is added in excess, then the transformation end time tends to be extended, and consequently the upper limit for the Zr content can be set to 0.05%.

Exemplary Structure of Wire Rod

Provided below is a description of the exemplary embodiment of a structure of the wire rod according to the present invention, which for the high-strength plated steel wire with excellent twist properties that represents the target of the exemplary embodiments of the present invention can be an important factor that affects the level of delamination prevention, the cold workability of the wire rod, and the degree of improvement in the reduction in area.

One exemplary factor that affects the occurrence of delamination in the high-strength plated steel wire can be the occurrence of non-pearlite structures, including bainites that may be generated along prior austenite grain boundaries of the wire rod, as well as grain boundary ferrites and degenerate pearlites. Moreover, because it is likely known that the surface layer acts as the origin for delamination, a wire rod such as described according the exemplary embodiment of the present invention can be provided, whereas the area fraction of non-pearlite structures in the region from the surface layer down to a depth of 100 μM is not more than 10%, may be able to suppress the occurrence of delamination during drawing and after plating treatment.

Moreover, reducing the quantity of non-pearlite structures within the central portion of the wire rod can be effective in improving the reduction in area. By ensuring that the area fraction of non-pearlite structures for the entire cross-section from the surface layer through to the center of the wire rod is not more than 5%, as is the case in the wire rod of the exemplary embodiment, the reduction in area can be improved.

Exemplary Method for Manufacturing Wire Rod

An exemplary embodiment of a method for manufacturing the wire rod for a high-strength plated steel wire having excellent twist properties according to the present invention is described herein.

In this exemplary embodiment, a slab (e.g., a steel billet) containing the steel components described above can be heated in an oven at 1,000 to 1,200° C., descaling can be performed immediately after the extraction from the oven, and rough rolling and finish rolling are then conducted to form a wire rod having a diameter of 9 to 16 mm. After completion of the rolling, cooling can be conducted at the final rolling stand, and the wire rod may then be coiled at a rod temperature of 800 to 950° C. Subsequently, within the time period t1 (seconds) represented by the formula shown below passes, a patenting treatment can be performed by immersing the wire rod in a molten salt at a temperature of 525 to 600° C.

$$t1=0.0013\times(Tr-815)^2+7\times(B-0.0003)/(N—Ti/3.41-B+0.0003) \quad (1)$$

(Heating Temperature: 1,000 to 1,200° C.)

The temperature at which the slab is heated can have an effect on the state in which each of the added elements exist, and on the decarburization of the slab. In order to ensure solid-solubilization of B, the heating temperature can be preferably at least 1,000° C. On the other hand, if the heating temperature of the slab exceeds 1,200° C., then decarburization within the surface layer of the slab increases markedly, and consequently the heating temperature is set within a range from 1,000 to 1,200° C. The slab can be preferably heated at a comparatively low temperature of 1,100° C. or lower and then subjected to an aging heat treatment in order to minimize decarburization.

(Time from Completion of Coiling to Start of Patenting Treatment: t1)

In order to obtain a wire rod having the structure and tensile strength prescribed in the exemplary embodiment using a slab having the composition described in the exemplary embodiment, it is preferable to prevent the precipitation of B carbides or nitrides, both during transport of the wire rod from the coiling stage that is conducted after rolling through to the start of the patenting treatment, and during the cooling conducted at the time of the patenting treatment, and moreover. It may also be preferable to ensure that the quantity of solid-solubilized B represents a mass % of at least 0.0002%. For example, when the structure and solid-solubilized B content are measured for a wire rod prepared by heating at 1,050° C., conducting rapid cooling to a temperature of 750 to 950° C. within 1 second, holding this temperature for a certain period of time, and then conducting lead patenting, then the holding time limit required to ensure a solid-solubilized B content of at least 0.0002% can be a C-shaped curve determined by the combination of the quantities of B and N, and the time limit t1 may be represented by the formula (1) shown below.

$$t1=0.0013\times(Tr-815)^2+7\times(B-0.0003)/(N—Ti/3.41-B+0.0003) \quad (1)$$

In the above formula (1), Tr is the coiling temperature, and the above formula is valid for component ranges in which (N—Ti/3.41−B+0.0003) is greater than zero. If this value is zero or less, then there is no particular limit on the holding time. However, in a practical rolling application, it is unlikely to take longer than, e.g., 40 seconds from the completion of coiling until the start of the patenting treatment, and therefore the upper limit can be set to 40 seconds.

(Coiling Temperature Tr for Wire Rod: 800 to 950° C.)

The coiling temperature Tr for the coiling that is conducted after rolling and water-cooling can affect the quantity of solid-solubilized B at the start of patenting.

In order to obtain a wire rod having the structure prescribed in the present embodiment, patenting must be started within the time period t1 represented by the above formula (1). If the coiling temperature Tr is less than 800° C., then B carbides tend to precipitate, and the effect of the solid-solubilized B in suppressing non-pearlite structures tends to be inadequate. In contrast, if the coiling temperature exceeds 950° C., then the γ grain size can become overly coarse, causing a deterioration in the reduction in area. Accordingly, the coiling temperature can typically be at least 800° C., preferably at least 850° C., and even more preferably 900° C. or higher, and should be at most 950° C.

(Patenting Temperature: 525 to 600° C.)

The patenting treatment of the wire rod can be conducted after coiling, either by a patenting method in which the coiled rod is immersed directly in a molten salt or molten lead at a temperature of 525 to 600° C., or by a patenting method in which the coiled rod can be initially cooled, is subsequently reheated to a temperature of at least 950° C. to effect reaustenitization, and is then immersed in molten lead at 525 to 600° C.

The patenting temperature for the wire rod can affect the structure of the wire rod after the patenting treatment, and the lamellar spacing of the pearlite. If the patenting temperature exceeds 600° C., then pearlite structures with a coarse lamellar spacing can be generated, which may cause reductions in the tensile strength and toughness. In contrast, for a steel wire with a high Si content such as the plated steel wire according to the exemplary embodiment of the present invention, if the patenting treatment is conducted at a temperature of less than 525° C., then the fraction of bainite structures within the material after patenting tends to increase dramatically. Within the region from the surface layer down to a depth of 100 μm, in order to suppress supercooling and restrict the area fraction of non-pearlite structures to not more than 10%, the temperature of the molten salt or molten lead is preferably set to at least 525° C.

By conducting the patenting treatment in the manner described above, non-pearlite structures within the entire cross-section of the wire rod (the rolled material) can be suppressed to not more than 5%, and a tensile strength TS represented by a formula (4) shown below can be ensured.

$$TS \geqq 1000 \times C + 300 \times Si - 10 \times d_0 + 250 \quad (4)$$

(whereas TS represents the tensile strength (MPa), C represents the C content (mass %) within the steel, Si represents the Si content (mass %) within the steel, and $d_0$ represents the wire diameter (mm))

Exemplary Method for Manufacturing Steel Wire

Exemplary reasons for providing the exemplary embodiment of the method for manufacturing a plated steel wire for PWS that exhibits excellent toughness, a high degree of strength and excellent twist properties using the wire rod manufactured under the conditions outlined above is provided below.

In the exemplary embodiment of the present invention, by subjecting the wire rod manufactured under the above conditions to cold working at a true strain, represented by a formula (2) shown below, of 1.2 to 1.9, a steel wire can be formed in which the area fraction of non-pearlite structures in the region from the surface layer down to a depth of 50 μm is not more than 10%, and the area fraction of non-pearlite structures within the entire cross-section is not more than 5%. Subsequently, galvanizing can be performed with a plating quantity within a range from 300 to 500 g/m$^2$.

$$\epsilon = 2 \cdot \ln(d_0/d) \quad (2)$$

(whereas $d_0$ represents the diameter (mm) of the steel wire rod prior to cold working, d represents the diameter (mm) of the steel wire after cold working, and ln represents a natural logarithm)

(True Strain ϵ: 1.2 to 1.9)

The true strain ϵ described herein for the exemplary embodiment of the present invention can be a parameter that represents the reduction in area from the original diameter, and as the true strain value can be increased, the value of TS likely also increases. However, if the true strain is less than 1.2, then localized twisting may occur when a twist test is conducted, and as a result, drawn wire with a true strain of at least 1.2 may be preferred. In contrast, if the true strain exceeds 1.9, then for that particular steel wire diameter, the reduction in area may decrease and delamination may also occur, and consequently the upper limit for the true strain can be set to 1.9.

(Plating Quantity: 300 to 500 g/m$^2$)

The plating quantity affects the corrosion resistance of the plated steel wire, and the larger the plating quantity becomes, the greater the time required to expose the surface of the steel wire, and therefore the greater the corrosion resistance. A satisfactory corrosion resistance can achieved at plating quantities of 300 g/m$^2$ or greater. On the other hand, if the plating quantity is too large, then detachment can become a problem, and therefore the upper limit for the plating quantity is set to 500 g/m$^2$.

As described above, in the exemplary embodiment, by setting the compositional relationship between the various components to the numerical ranges described above, and ensuring the existence, within the austenite prior to patenting treatment, of solid-solubilized B in a quantity corresponding with the quantities of C and Si, the driving forces for cementite precipitation and ferrite precipitation can be balanced, and the generation of non-pearlite structures may be suppressed. As a result, the ductility can be improved, and wire breakages during the drawing process can be prevented, meaning the productivity and the yield can be increased during the production of the plated steel wire for PWS.

Further, even in the case of a plated steel wire prepared by performing a plating treatment on a cold worked steel wire, because the wire has a structure containing mainly pearlite, in which the area fraction of non-pearlite structures has been reduced, a plated steel wire for PWS having excellent twist properties can still be obtained.

Furthermore, in the exemplary embodiment, a plated steel wire of diameter 4.5 to 7.5 mm, which can represent the diameter typically used for PWS, may be manufactured, for example, from a wire rod having the predetermined steel components and structures described above, and having a diameter of 9 to 16 mm. Even at this steel wire diameter, e.g., because the structure contains mainly pearlite structures, the wire can have a high degree of strength, indicated by a tensile strength that satisfies $TS \geqq 2192 - 61 \times d$ (wherein, TS represents the tensile strength (MPa) and d represents the wire diameter (mm)), and also likely exhibits excellent drawing properties, meaning a plated steel wire for PWS with excellent twist properties can be manufactured in a stable manner.

EXAMPLES

A detailed description of certain exemplary embodiment of the present invention is provided below based on a series of examples. It should be understood that the present invention is in no way limited by the examples described below, and many modifications can be made within the scope of the present invention, with all of these modifications deemed to fall within the technical scope of the exemplary embodiments the present invention.

Exemplary Method of Preparing Samples

Tables 1 and 2, and Tables 5 and 6 show the chemical compositions of sample materials, the patenting conditions, and the mechanical properties of the prepared wire rods. These sample materials were hot rolled to generate wire rods of a predetermined diameter, coiled at a predetermined temperature, and then within a predetermined time passes, subjected to either direct molten salt patenting (DLP) or reheated molten lead patenting (LP). Even for examples having the same components, variation in the time elapsed between coiling and the patenting treatment causes a variation in the quantity of B nitride precipitation, meaning the quantity of solid-solubilized B also differs.

Subsequently, using these patented materials, a drawing process was conducted via a prescribed cooling method until a predetermined wire diameter was obtained, and a molten galvanizing treatment was then performed. The molten galvanizing bath temperature was 450° C.

These wire rods, steel wires, and plated steel wires were evaluated using the evaluation methods described below.

Exemplary Evaluation Test Methods

The quantity of solid-solubilized B was determined by conducting a measurement of the patented wire rod using a methylene blue absorption spectroscopic method.

The fraction of non-pearlite structures was determined by embedding the patented wire rod or the steel wire that had undergone drawing within a resin, grinding the embedded structure, conducting chemical corrosion using picric acid, and then determining the fraction of non-pearlite structures within a cross-section (an L-section) parallel to the longitudinal direction of the wire rod based on SEM observation of the structure.

The fraction of non-pearlite structures within the surface layer of the rolled wire rod was determined by first cutting and grinding the wire rod so as to expose an L-section in a region from the center of the wire rod to −5% to +5% of the radius. For the surface layer portion, SEM structural observation was used to take structure photographs with a magnification of 2000× of 5 views of regions within a depth of 100 μm from the surface and with a width of 100 μm, image analysis was used to measure the non-pearlite area fraction within each region, and the average value of those measurements was determined as the surface layer non-pearlite area fraction (non-pearlite area fraction within surface layer).

The fraction of non-pearlite structures within the surface layer of a drawn steel wire was determined by first cutting and grinding the wire rod so as to expose an L-section in a region from the center of the wire rod to −5% to +5% of the radius. For the surface layer portion, SEM structural observation was used to take structure photographs with a magnification of 2000× of 5 views of regions within a depth of 40 μm from the surface and with a width of 100 μm, image analysis was used to measure the non-pearlite area fraction within each region, and the average value of those measurements was determined as the surface layer non-pearlite area fraction (non-pearlite area fraction within surface layer).

The non-pearlite area fraction through the entire cross-section of the rolled wire rod or steel wire was determined by using SEM structural observation to take structure photographs with a magnification of 2000× of 5 views of regions with a depth of 100 μm and a width of 100 μM in the central portion (the ½D portion, wherein D represents the diameter of the wire rod or steel wire) of a cross-section (L-section) parallel to the longitudinal direction of the wire rod or steel wire. Image analysis was then used to measure the non-pearlite area fraction within each region, and the average value of those measurements was determined as the cross-sectional non-pearlite area fraction (non-pearlite area fraction within entire cross-section).

These measurements confirmed that the area fraction of non-pearlite structures prior to drawing was substantially equal to the area fraction of non-pearlite structures after drawing.

When a decarburized layer was present at the surface layer, the totally decarburized portion, as specified in JIS G 0558 (4) was excluded from the measurement.

The tensile strength TS (MPa) was measured by conducting a tensile test under conditions including a gauge length of 200 mm and a speed of 10 mm/minute, and the average value was determined for n=3 (namely, the measurement was performed three times, and the average value of the measured results was calculated).

A twist test was conducted under conditions including a gauge length of 100 D mm (wherein, D represents the diameter of the steel wire) and a speed of 20 rpm. For n=3 (namely three test repetitions), the number of revolutions until breakage was measured as the twist value, and the average value of these measured twist values was calculated. The occurrence or absence of delamination was determined from a torque pattern measured at the same time as the twist test. Moreover, the existence of localized twisting was determined on the basis of the sample twist test results.

Tables 1 and 2 show the compositions and wire rod production conditions for inventive steels (steels of the exemplary embodiment of the present invention) and comparative steels labeled No. 1 to No. 16. Tables 3 and 4 show a list of the plated steel wire production conditions and the exemplary evaluation results.

TABLE 1

| | | Component (mass %) | | | | | | | | | |
|---|---|---|---|---|---|---|---|---|---|---|---|
| No. | Classification | C | Si | Mn | P | S | B | Al | Ti | N | Cr |
| 1 | Inventive steel | 0.86 | 0.91 | 0.76 | 0.008 | 0.008 | 0.0018 | 0.043 | 0.000 | 0.0044 | — |
| 2 | Inventive steel | 0.86 | 0.91 | 0.76 | 0.008 | 0.008 | 0.0018 | 0.043 | 0.000 | 0.0044 | — |
| 3 | Inventive steel | 0.86 | 0.91 | 0.76 | 0.008 | 0.008 | 0.0018 | 0.043 | 0.000 | 0.0044 | — |
| 4 | Comparative steel | 0.86 | 0.91 | 0.76 | 0.008 | 0.008 | 0.0018 | 0.043 | 0.000 | 0.0044 | — |
| 5 | Inventive steel | 0.86 | 0.90 | 0.75 | 0.008 | 0.006 | 0.0022 | 0.043 | 0.010 | 0.0040 | — |
| 6 | Inventive steel | 0.86 | 0.90 | 0.75 | 0.008 | 0.006 | 0.0022 | 0.043 | 0.010 | 0.0040 | — |
| 7 | Comparative steel | 0.86 | 0.90 | 0.75 | 0.008 | 0.006 | 0.0022 | 0.043 | 0.010 | 0.0040 | — |
| 8 | Comparative steel | 0.87 | 0.90 | 0.74 | 0.008 | 0.008 | 0.0000 | 0.041 | 0.000 | 0.0043 | — |
| 9 | Comparative steel | 0.87 | 0.90 | 0.74 | 0.008 | 0.008 | 0.0000 | 0.041 | 0.000 | 0.0043 | — |
| 10 | Comparative steel | 0.87 | 0.90 | 0.74 | 0.008 | 0.008 | 0.0000 | 0.041 | 0.000 | 0.0043 | — |
| 11 | Comparative steel | 0.87 | 0.90 | 0.74 | 0.008 | 0.008 | 0.0000 | 0.041 | 0.000 | 0.0043 | — |
| 12 | Inventive steel | 0.87 | 1.00 | 0.40 | 0.008 | 0.005 | 0.0020 | 0.035 | 0.000 | 0.0025 | 0.25 |
| 13 | Inventive steel | 0.87 | 1.00 | 0.40 | 0.008 | 0.005 | 0.0020 | 0.035 | 0.000 | 0.0025 | 0.25 |
| 14 | Comparative steel | 0.87 | 0.99 | 0.42 | 0.008 | 0.006 | 0.0000 | 0.038 | 0.000 | 0.0032 | 0.25 |
| 15 | Inventive steel | 0.87 | 0.90 | 0.75 | 0.007 | 0.006 | 0.0012 | 0.030 | 0.012 | 0.0035 | — |
| 16 | Inventive steel | 0.87 | 0.90 | 0.75 | 0.007 | 0.006 | 0.0012 | 0.030 | 0.012 | 0.0035 | — |

TABLE 2

| | Patenting conditions and properties of wire rods | | | | | | | | | | | |
|---|---|---|---|---|---|---|---|---|---|---|---|---|
| No. | Diameter (mm) | Coiling temperature (° C.) | Time between coiling and immersion (seconds) | t1 (seconds) | Patenting method | Bath temperature (° C.) | TS (MPa) | TS threshold (MPa) | Reduction in area (%) | Non-pearlite area fraction within surface layer (%) | Non-pearlite area fraction within entire cross-section (%) | Quantity of solid-solubilized B (%) |
| 1 | 12 | 920 | 16 | 17.95 | DLP | 550 | 1338 | 1263 | 41 | 7.5 | 3.5 | 0.0005 |
| 2 | 12 | 920 | 16 | 17.95 | DLP | 550 | 1338 | 1263 | 41 | 7.5 | 3.5 | 0.0005 |
| 3 | 12 | 920 | 16 | 17.95 | LP | 560 | 1325 | 1263 | 38 | 8.6 | 4.2 | 0.0003 |
| 4 | 12 | 920 | 16 | 17.95 | DP | — | 1165 | 1263 | 46 | 14.5 | 6.9 | <0.0002 |
| 5 | 12 | 920 | 16 | 40 | DLP | 550 | 1335 | 1260 | 40 | 4.3 | 1.8 | 0.0012 |
| 6 | 12 | 920 | 16 | 40 | LP | 560 | 1314 | 1260 | 33 | 5.0 | 2.3 | 0.0010 |
| 7 | 12 | 920 | 16 | 40 | DP | — | 1124 | 1260 | 45 | 9.5 | 3.0 | 0.0005 |
| 8 | 12 | 920 | 16 | — | DLP | 550 | 1297 | 1270 | 40 | 11.2 | 0.9 | <0.0002 |
| 9 | 12 | 920 | 16 | — | DLP | 550 | 1297 | 1270 | 40 | 11.2 | 0.9 | <0.0002 |
| 10 | 12 | 920 | 16 | — | LP | 560 | 1300 | 1270 | 29 | 12.5 | 1.5 | <0.0002 |
| 11 | 12 | 920 | 16 | — | DP | — | 1125 | 1270 | 44 | 16.5 | 7.2 | <0.0002 |
| 12 | 14 | 880 | 14 | 20.37 | DLP | 550 | 1446 | 1280 | 49 | 8.0 | 1.5 | 0.0006 |
| 13 | 14 | 880 | 14 | 20.37 | LP | 570 | 1421 | 1280 | 41 | 5.1 | 0.8 | 0.0004 |
| 14 | 14 | 880 | 14 | — | DLP | 550 | 1425 | 1277 | 46 | 12.5 | 3.0 | <0.0002 |
| 15 | 13.5 | 825 | 16 | 40 | DLP | 550 | 1345 | 115 | 43 | 8.0 | 0.9 | 0.0009 |
| 16 | 13.5 | 825 | 16 | 40 | DLP | 530 | 1356 | 115 | 40 | 9.6 | 1.1 | 0.0010 |

TABLE 3

| | | Drawing conditions and properties of steel wire following drawing | | | | | | | |
|---|---|---|---|---|---|---|---|---|---|
| No. | Classification | Diameter (mm) | True strain | TS (MPa) | Non-pearlite area fraction within surface layer (%) | Non-pearlite area fraction within entire cross-section (%) | Reduction in area (%) | Twist value (revolutions) | Occurrence of delamination |
| 1 | Inventive steel | 5.3 | 1.63 | 1991 | 7.4 | 3.5 | 58 | 30 | No |
| 2 | Inventive steel | 4.9 | 1.78 | 1999 | 7.0 | 3.5 | 54 | 30 | No |
| 3 | Inventive steel | 5.3 | 1.63 | 1946 | 8.7 | 4.2 | 53 | 28 | No |
| 5 | Inventive steel | 5.3 | 1.63 | 1978 | 4.0 | 1.8 | 57 | 28 | No |
| 6 | Inventive steel | 5.3 | 1.63 | 1943 | 5.8 | 2.3 | 50 | 24 | No |
| 8 | Comparative steel | 5.3 | 1.63 | 1941 | 10.5 | 0.9 | 57 | 32 | Yes |
| 9 | Comparative steel | 4.9 | 1.78 | 1985 | 10.3 | 0.9 | 56 | 31 | Yes |
| 10 | Comparative steel | 5.3 | 1.63 | 1929 | 11.0 | 1.5 | 44 | 20 | Yes |
| 12 | Inventive steel | 6.9 | 1.42 | 1970 | 7.5 | 1.5 | 55 | 34 | No |
| 13 | Inventive steel | 6.9 | 1.42 | 1945 | 5.5 | 0.8 | 49 | 31 | No |
| 14 | Comparative steel | 6.9 | 1.42 | 1949 | 10.5 | 3.0 | 53 | 33 | No |
| 15 | Inventive steel | 6.9 | 1.34 | 1841 | 7.5 | 0.9 | 54 | 32 | No |
| 16 | Inventive steel | 6.9 | 1.34 | 1855 | 8.5 | 1.1 | 53 | 34 | No |

TABLE 4

| | Plating conditions and properties of plated steel wire | | | | | | |
|---|---|---|---|---|---|---|---|
| No. | Plating quantity ($g/m^2$) | TS (MPa) | TS threshold (MPa) | Elongation (%) | Reduction in area (%) | Twist value (revolutions) | Occurrence of delamination |
| 1 | 338 | 1895 | 1863 | 5.8 | 44 | 21 | No |
| 2 | 359 | 1948 | 1887 | 5.9 | 44 | 22 | No |
| 3 | 364 | 1873 | 1863 | 5.6 | 42 | 21 | No |
| 5 | 368 | 1893 | 1863 | 5.5 | 41 | 23 | No |
| 6 | 360 | 1887 | 1863 | 4.8 | 36 | 21 | No |
| 8 | 362 | 1879 | 1863 | 5.0 | 37 | 23 | No |
| 9 | 331 | 1958 | 1887 | 5.3 | 42 | 6 | Yes |
| 10 | 358 | 1867 | 1863 | 3.7 | 28 | 8 | Yes |
| 12 | 374 | 1945 | 1765 | 4.8 | 36 | 23 | No |
| 13 | 342 | 1930 | 1765 | 4.1 | 31 | 22 | No |
| 14 | 372 | 1926 | 1765 | 3.9 | 30 | 13 | Yes |
| 15 | 360 | 1823 | 1765 | 6.0 | 42 | 21 | No |
| 16 | 361 | 1827 | 1765 | 5.8 | 44 | 20 | No |

Exemplary Evaluation Test Results

In Tables 1 to 4, the samples represented by Nos. 1 to 3, 5, 6, 12, 13, 15 and 16 each represent a plated steel wire for PWS of the present invention (an inventive steel) that exhibits excellent twist properties, whereas the samples represented by Nos. 4, 7 to 11 and 14 each represent a conventional plated steel wire (a comparative steel).

As is evident from Tables 1 to 4, each of the wire rods of the samples labeled Nos. 1 to 3, 5, 6, 12, 13, 15 and 16 (namely, the inventive steels) had a B content that satisfied the range from 0.0004 to 0.0060%, and also satisfied the condition that the time from completing coiling until the start of patenting is not more than t1. Here, t1 is represented by the formula: $t1=0.0013\times(Tr-815)^2+7\times(B-0.0003)/(N—Ti/3.41-B+0.0003)$. As a result, each of the wire rods had a quantity of solid-solubilized B of at least 0.0002%, had an area fraction of non-pearlite structures in the region from the wire rod surface layer down to a depth of 100 μm of not more than 10%, and had an area fraction of non-pearlite structures in the entire cross-section of the wire rod of not more than 5%. Further, each of the patented materials had a strength that satisfied the formula: $TS\geqq(1000\times C+300\times Si-10\times d_0+250)$ (the TS threshold) and was also 1,250 MPa or greater.

Moreover, after cold working and the galvanizing treatment, neither delamination nor localized twisting occurred, and the strength was at least 1,870 MPa in each case.

Only the sample No. 8 (a comparative steel) exhibited delamination in the drawn wire state but then suffered no delamination after the galvanizing treatment, and also satisfied the strength requirement of 1,870 MPa.

In contrast, the wire rods of the samples No. 4 and No. 7 (comparative steels) each exhibited a time from the completion of coiling until the start of patenting that was longer than t1, and as a result, the quantity of solid-solubilized B could not be ensured, the quantity of non-pearlite structures could not be suppressed, and because the cooling rate was slow, the prescribed tensile strength (the TS threshold) could not be satisfied. Here, t1 is represented by the formula: $t1=0.0013\times(Tr-815)^2+7\times(B-0.0003)/(N—Ti/3.41-B+0.0003)$.

Furthermore, in the samples of Nos. 9, 10 and 14 (comparative steels), because the B content did not satisfy the prescribed quantity, the quantity of solid-solubilized B could not be ensured, and the occurrence of non-pearlite structures could not be suppressed. Moreover, delamination occurred both after drawing and after the galvanizing treatment.

Tables 5 and 6 show the compositions and wire rod production conditions for inventive steels and comparative steels labeled No. 17 to No. 35. Tables 7 and 8 show a list of the plated steel wire production conditions and the evaluation results.

TABLE 5

| | | Component | | | | | | | | |
|---|---|---|---|---|---|---|---|---|---|---|
| No. | Classification | C | Si | Mn | P | S | B | Al | Ti | N |
| 17 | Inventive steel | 0.82 | 1.20 | 0.70 | 0.007 | 0.006 | 0.0030 | 0.000 | 0.010 | 0.0035 |
| 18 | Inventive steel | 0.85 | 1.00 | 0.30 | 0.009 | 0.007 | 0.0016 | 0.000 | 0.008 | 0.0028 |
| 19 | Inventive steel | 0.87 | 1.20 | 0.50 | 0.009 | 0.008 | 0.0015 | 0.032 | 0.000 | 0.0040 |
| 20 | Inventive steel | 0.92 | 1.00 | 0.60 | 0.006 | 0.007 | 0.0022 | 0.000 | 0.010 | 0.0028 |
| 21 | Inventive steel | 0.92 | 0.85 | 0.50 | 0.009 | 0.009 | 0.0018 | 0.035 | 0.000 | 0.0044 |
| 22 | Inventive steel | 0.92 | 0.90 | 0.70 | 0.006 | 0.006 | 0.0012 | 0.000 | 0.008 | 0.0032 |
| 23 | Inventive steel | 0.92 | 1.20 | 0.40 | 0.010 | 0.004 | 0.0018 | 0.045 | 0.000 | 0.0026 |
| 24 | Inventive steel | 0.98 | 0.90 | 0.75 | 0.008 | 0.005 | 0.0022 | 0.041 | 0.010 | 0.0040 |
| 25 | Inventive steel | 0.98 | 1.20 | 0.40 | 0.010 | 0.004 | 0.0015 | 0.030 | 0.000 | 0.0031 |
| 26 | Inventive steel | 1.05 | 1.00 | 0.30 | 0.009 | 0.003 | 0.0020 | 0.032 | 0.010 | 0.0040 |
| 27 | Comparative steel | 0.70 | 0.90 | 0.50 | 0.009 | 0.008 | 0.0015 | 0.030 | 0.000 | 0.0025 |
| 28 | Comparative steel | 0.80 | 1.60 | 0.50 | 0.008 | 0.002 | 0.0020 | 0.029 | 0.000 | 0.0030 |
| 29 | Comparative steel | 0.82 | 1.10 | 1.30 | 0.011 | 0.005 | 0.0030 | 0.000 | 0.010 | 0.0038 |
| 30 | Comparative steel | 0.87 | 0.90 | 0.50 | 0.008 | 0.007 | 0.0008 | 0.020 | 0.000 | 0.0050 |
| 31 | Comparative steel | 0.92 | 1.00 | 0.40 | 0.008 | 0.005 | 0.0015 | 0.050 | 0.000 | 0.0025 |
| 32 | Comparative steel | 0.98 | 0.40 | 0.50 | 0.015 | 0.004 | 0.0021 | 0.031 | 0.000 | 0.0020 |
| 33 | Comparative steel | 1.00 | 0.90 | 0.60 | 0.007 | 0.007 | 0.0070 | 0.043 | 0.010 | 0.0030 |
| 34 | Comparative steel | 1.10 | 1.20 | 0.40 | 0.012 | 0.009 | 0.0005 | 0.040 | 0.000 | 0.0060 |
| 35 | Comparative steel | 1.15 | 0.90 | 0.70 | 0.007 | 0.006 | 0.0025 | 0.020 | 0.010 | 0.0035 |

| | | Component | | | | | | | | |
|---|---|---|---|---|---|---|---|---|---|---|
| No. | Classification | Cr | Ni | Co | V | Cu | Mo | W | Nb | Zr |
| 17 | Inventive steel | 0.20 | 0.20 | — | — | 0.05 | — | — | — | — |
| 18 | Inventive steel | 0.10 | 0.10 | — | 0.10 | — | — | — | — | — |
| 19 | Inventive steel | 0.20 | — | — | — | — | — | — | — | 0.01 |
| 20 | Inventive steel | — | — | — | — | — | — | 0.10 | 0.10 | — |
| 21 | Inventive steel | 0.10 | — | 0.10 | — | — | — | — | 0.10 | — |
| 22 | Inventive steel | — | — | — | — | — | — | 0.05 | 0.10 | — |
| 23 | Inventive steel | 0.20 | — | — | — | — | 0.10 | — | 0.10 | — |
| 24 | Inventive steel | — | — | — | 0.10 | — | — | — | — | — |
| 25 | Inventive steel | 0.20 | — | — | — | — | — | — | — | — |
| 26 | Inventive steel | 0.20 | — | — | — | — | 0.10 | — | — | — |
| 27 | Comparative steel | — | — | — | — | — | — | — | — | — |
| 28 | Comparative steel | — | — | — | — | — | — | — | — | — |
| 29 | Comparative steel | 0.20 | — | — | — | 0.10 | — | — | — | — |
| 30 | Comparative steel | — | — | — | 0.10 | — | — | — | — | 0.01 |
| 31 | Comparative steel | 0.10 | — | 0.10 | — | — | — | — | — | — |
| 32 | Comparative steel | — | — | — | 0.10 | — | — | — | — | — |
| 33 | Comparative steel | — | 0.20 | — | — | — | — | — | 0.10 | — |
| 34 | Comparative steel | 0.10 | — | 0.10 | 0.05 | — | — | — | — | — |
| 35 | Comparative steel | — | 0.20 | — | — | — | — | — | 0.10 | — |

TABLE 6

| | Patenting conditions and properties of wire rods | | | | | | | | | | | |
|---|---|---|---|---|---|---|---|---|---|---|---|---|
| No. | Diameter (mm) | Coiling temperature (° C.) | Time between coiling and immersion (seconds) | t1 (seconds) | Patenting method | Bath temperature (° C.) | TS (MPa) | TS threshold (MPa) | Reduction in area (%) | Non-pearlite area fraction within surface layer (%) | Non-pearlite area fraction within entire cross-section (%) | Quantity of solid-solubilized B (%) |
| 17 | 10 | 880 | 14 | 40 | DLP | 550 | 1398 | 1330 | 49 | 7.6 | 2.1 | 0.0017 |
| 18 | 10 | 825 | 14 | 40 | DLP | 550 | 1463 | 1300 | 46 | 6.8 | 2.0 | 0.0010 |
| 19 | 12 | 920 | 16 | 17 | DLP | 550 | 1423 | 1360 | 47 | 8.9 | 1.5 | 0.0004 |
| 20 | 12 | 850 | 16 | 40 | DLP | 550 | 1413 | 1350 | 43 | 6.5 | 0.8 | 0.0011 |
| 21 | 12 | 930 | 18 | 21 | DLP | 550 | 1426 | 1305 | 46 | 4.3 | 0.7 | 0.0004 |
| 22 | 15 | 830 | 22 | 40 | DLP | 550 | 1351 | 1290 | 43 | 7.0 | 1.3 | 0.0005 |
| 23 | 12 | 900 | 18 | 19 | DLP | 550 | 1485 | 1410 | 45 | 8.2 | 2.5 | 0.0006 |
| 24 | 12 | 850 | 20 | 40 | DLP | 550 | 1545 | 1380 | 42 | 7.0 | 1.6 | 0.0009 |
| 25 | 15 | 920 | 16 | 19 | DLP | 550 | 1500 | 1440 | 44 | 8.2 | 1.2 | 0.0005 |
| 26 | 12 | 880 | 18 | 40 | DLP | 550 | 1588 | 1480 | 40 | 7.2 | 2.2 | 0.0008 |
| 27 | 12 | 900 | 14 | 16 | DLP | 550 | 1170 | 1100 | 45 | 6.5 | 1.5 | 0.0005 |
| 28 | 12 | 900 | 18 | 19 | DLP | 550 | 1335 | 1410 | 40 | 15.2 | 5.5 | 0.0006 |
| 29 | 12 | 850 | 18 | 40 | DLP | 550 | 1372 | 1280 | 37 | 7.2 | 4.8 | 0.0015 |
| 30 | 12 | 870 | 18 | 5 | DLP | 550 | 1439 | 1270 | 38 | 11.8 | 5.2 | >0.0002 |
| 31 | 14 | 920 | 20 | 21 | DLP | 520 | 1267 | 1330 | 40 | 46.5 | 28.7 | 0.0006 |
| 32 | 12 | 830 | 18 | 40 | DLP | 550 | 1501 | 1230 | 41 | 4.5 | 0.9 | 0.0007 |
| 33 | 12 | 950 | 16 | 17 | DLP | 550 | 1465 | 1400 | 32 | 7.9 | 2.8 | 0.0038 |
| 34 | 14 | 850 | 20 | 2 | DLP | 550 | 1644 | 1570 | 46 | 12.0 | 5.5 | >0.0002 |
| 35 | 12 | 850 | 18 | 40 | DLP | 550 | 1617.3637 | 1550 | 31 | 6.9 | 3.5 | 0.0013 |

TABLE 7

| | | Drawing conditions and properties of steel wire after drawing | | | | | | | |
|---|---|---|---|---|---|---|---|---|---|
| No. | Classification | Diameter (mm) | True strain | TS (MPa) | Non-pearlite area fraction within surface layer (%) | Non-pearlite area fraction within entire cross-section (%) | Reduction in area (%) | Twist value (revolutions) | Occurrence of delamination |
| 17 | Inventive steel | 4.5 | 1.6 | 1994 | 7.0 | 2.1 | 58 | 31 | No |
| 18 | Inventive steel | 5.3 | 1.27 | 1941 | 6.5 | 2.0 | 55 | 30 | No |
| 19 | Inventive steel | 4.9 | 1.78 | 2045 | 8.6 | 1.5 | 54 | 30 | No |
| 20 | Inventive steel | 5.3 | 1.63 | 2003 | 6.5 | 0.8 | 54 | 28 | No |
| 21 | Inventive steel | 5.3 | 1.63 | 2017 | 4.8 | 0.7 | 56 | 31 | No |
| 22 | Inventive steel | 6.9 | 1.55 | 1957 | 7.3 | 1.3 | 51 | 29 | No |
| 23 | Inventive steel | 5.3 | 1.63 | 2040 | 7.9 | 2.5 | 56 | 32 | No |
| 24 | Inventive steel | 5.3 | 1.63 | 2069 | 7.2 | 1.6 | 55 | 30 | No |
| 25 | Inventive steel | 6.9 | 1.55 | 2089 | 7.5 | 1.2 | 54 | 31 | No |
| 26 | Inventive steel | 5.3 | 1.63 | 2129 | 6.6 | 2.2 | 52 | 29 | No |
| 28 | Comparative steel | 4.9 | 1.78 | 2002 | 14.3 | 5.5 | 52 | 27 | Yes |
| 29 | Comparative steel | 5.3 | 1.63 | 1997 | 6.9 | 4.8 | 45 | 20 | Yes |
| 30 | Comparative steel | 5.3 | 1.63 | 2016 | 12.0 | 5.2 | 56 | 28 | No |
| 32 | Comparative steel | 5.3 | 1.63 | 2047 | 4.5 | 0.9 | 55 | 31 | No |
| 33 | Comparative steel | 5.3 | 1.63 | 2029 | 7.9 | 2.8 | 49 | 28 | Yes |
| 34 | Comparative steel | 6.9 | 1.42 | 2068 | 11.0 | 5.5 | 52 | 28 | No |
| 35 | Comparative steel | 5.3 | 1.63 | 2105 | 7.4 | 2.8 | 48 | 24 | Yes |

TABLE 8

| | Plating conditions and properties of plated steel wire | | | | | | |
|---|---|---|---|---|---|---|---|
| No. | Plating quantity ($g/m^2$) | TS (MPa) | TS threshold (MPa) | Elongation (%) | Reduction in area (%) | Twist value (revolutions) | Occurrence of delamination |
| 17 | 334 | 1971 | 1918 | 6.2 | 46 | 25 | No |
| 18 | 340 | 1915 | 1863 | 5.9 | 45 | 18 | No |
| 19 | 356 | 1993 | 1887 | 5.8 | 44 | 18 | No |
| 20 | 344 | 1961 | 1863 | 5.4 | 40 | 21 | No |
| 21 | 355 | 1960 | 1863 | 5.5 | 42 | 22 | No |
| 22 | 366 | 1918 | 1765 | 5.9 | 44 | 21 | No |
| 23 | 334 | 2000 | 1863 | 6.2 | 47 | 19 | No |
| 24 | 350 | 1978 | 1863 | 5.7 | 43 | 19 | No |
| 25 | 360 | 2031 | 1765 | 5.8 | 44 | 14 | No |

TABLE 8-continued

| No. | Plating quantity ($g/m^2$) | TS (MPa) | TS threshold (MPa) | Elongation (%) | Reduction in area (%) | Twist value (revolutions) | Occurrence of delamination |
|---|---|---|---|---|---|---|---|
| | Plating conditions and properties of plated steel wire | | | | | | |
| 26 | 358 | 2019 | 1863 | 5.2 | 38 | 17 | No |
| 28 | 350 | 1977 | 1887 | 5.0 | 38 | 13 | Yes |
| 29 | 353 | 1953 | 1863 | 3.7 | 28 | 8 | Yes |
| 30 | 343 | 1949 | 1863 | 5.5 | 42 | 19 | Yes |
| 32 | 342 | 1850 | 1863 | 3.7 | 29 | 22 | No |
| 33 | 373 | 1948 | 1863 | 3.9 | 30 | 12 | Yes |
| 34 | 352 | 2009 | 1765 | 5.5 | 40 | 5 | Yes |
| 35 | 321 | 1988 | 1863 | 3.0 | 27 | 8 | Yes |

In Tables 5 to 8, the samples represented by Nos. 17 to 26 each represent a plated steel wire for PWS of the present invention (an inventive steel) that exhibits excellent twist properties, the samples represented by Nos. 27 to 30 and 32 to 35 each represent a comparative steel in which the quantity of one of the components is outside the range prescribed in the present invention, and the sample represented by No. 31 is a comparative steel in which the patenting temperature is outside the temperature range prescribed in the present invention.

As is evident from Tables 5 to 8, each of the wire rods of the samples labeled Nos. 15 to 24 (namely, the inventive steels) had a B content that satisfied the range from 0.0004 to 0.0060%, and also satisfied the condition that the time from completing coiling until the start of patenting is not more than t1. Here, t1 is represented by the formula: $t1=0.0013\times(Tr-815)^2+7\times(B-0.0003)/(N—Ti/3.41-B+0.0003)$. As a result, each of the wire rods had a quantity of solid-solubilized B of at least 0.0002%, had an area fraction of non-pearlite structures in the region from the wire rod surface layer down to a depth of 100 μm of not more than 10%, and had an area fraction of non-pearlite structures in the entire cross-section of the wire rod of not more than 5%. Further, each of the patented materials had a strength that satisfied the formula: $TS\geqq(1000\times C+300\times Si-10\times d_0+250)$ (the TS threshold) and was also 1,250 MPa or greater.

Moreover, after cold working and the galvanizing treatment, neither delamination nor localized twisting occurred, and the strength was at least 1,870 MPa in each case.

In contrast, in the wire rod of the sample No. 27 (a comparative steel), the C content was 0.7%, which does not satisfy the quantity prescribed in the present invention, and the tensile strength of the wire rod did not reach 1,250 MPa, and the tensile strength of the plated steel wire did not reach 1,870 MPa.

In the wire rod of the sample No. 28 (a comparative steel), because the Si content was 1.6%, which represents an excessive amount, the quantity of non-pearlite structures could not be suppressed. Moreover, delamination could not be prevented after drawing, nor after the galvanizing treatment.

In the wire rod of the sample No. 29 (a comparative steel), because the Mn content was 1.3%, which represents an excessive amount, the generation of micro-martensites could not be suppressed. Moreover, delamination occurred after drawing and after the galvanizing treatment.

The wire rods of the samples No. 30 and No. 34 (comparative steels) each exhibited a time from the completion of coiling until the start of patenting that was longer than t1, and as a result, the quantity of solid-solubilized B could not be ensured, and the quantity of non-pearlite structures could not be suppressed. Moreover, delamination occurred after drawing, and after the galvanizing treatment. Here, t1 is represented by the formula: $t1=0.0013\times(Tr-815)^2+7\times(B-0.0003)/(N—Ti/3.41-B+0.0003)$.

In the wire rod of the sample No. 31 (a comparative steel), the patenting temperature was outside the temperature range prescribed in the present invention, and not only could non-pearlite structures not be suppressed, but delamination occurred after drawing, and after the galvanizing treatment.

In the wire rod of the sample No. 32 (a comparative steel), because the Si content was not sufficient to satisfy the range prescribed in the present invention, when the galvanizing treatment was conducted after drawing of the wire rod, the fall in the TS value was large, and the prescribed tensile strength could not be achieved.

In the wire rod of the sample No. 33 (a comparative steel), because the B content was 0.007%, which represents an excessive amount, B carbides precipitated. Moreover, delamination occurred after drawing, and after the galvanizing treatment.

In the wire rod of the sample No. 35 (a comparative steel), because the C content was 1.15%, which represents an excessive amount, precipitation of proeutectoid cementites could not be suppressed. Moreover, delamination occurred after drawing, and after the galvanizing treatment.

FIG. 1 is a graph that shows an exemplary non-pearlite area fraction within surface layer along the vertical axis, and the tensile strength (MPa) along the horizontal axis, and can be used for describing the effect of these factors on delamination occurrence for portions of the plated steel wires used in the examples. In the graph, white circles represent the exemplary embodiments of the steels according to the present invention shown in Tables 1 to 4, white diamonds represent the inventive steels shown in Tables 5 to 8, black circles represent the comparative steels shown in Tables 1 to 4, and black diamonds represent the comparative steels shown in Tables 5 to 8.

INDUSTRIAL APPLICABILITY

According to the exemplary embodiments of the present invention, by specifying the composition of the steel, and ensuring the existence, within the austenite prior to patenting treatment, of solid-solubilized B in a quantity corresponding with the quantities of C and Si, a wire rod can be obtained in which pearlite structures are predominant, the area fraction of non-pearlite structures in the region from the surface layer down to a depth of 100 μm is not more than 10%, and the area fraction of non-pearlite structures within the entire cross-section is not more than 5%. As a result, a plated steel wire for PWS can be manufactured that exhibits excellent twist properties, has a wire diameter within a range from 4.5 to 7.5 mm, and has a tensile strength that satisfies the formula: TS≧2192−61×d (whereas, TS represents the tensile strength (MPa) and d represents the wire diameter (mm)).

The foregoing merely illustrates the exemplary principles of the present invention. Various modifications and alterations to the described embodiments will be apparent to those skilled in the art in view of the teachings herein. It will thus be appreciated that those skilled in the art will be able to devise numerous modification to the exemplary embodiments of the present invention which, although not explicitly shown or described herein, embody the principles of the invention and are thus within the spirit and scope of the invention. All publications, applications and patents cited above are incorporated herein by reference in their entireties.

The invention claimed is:

1. A plated steel wire for a parallel wire strand (PWS) with excellent twist properties, comprising:

in terms of mass %:

0.8 to 1.1% of C, 0.8 to 1.3% of Si, 0.3 to 0.8% of Mn, 0.001 to 0.006% of N, and 0.0004 to 0.0060% of B, wherein a quantity of solid-solubilized B is at least 0.0002%, and at least one or both of 0.005 to 0.1% of Al and 0.005 to 0.1% of Ti, and, with the remainder being Fe and unavoidable impurities, wherein an area fraction of non-pearlite structures in a region from a surface layer to a depth of about 50 μm is at most 10%, an area fraction of non-pearlite structures within an entire cross-section of the steel wire is at most 5%, a surface of the steel wire is galvanized with a plating quantity that is within a range of between 300 to 500 $g/m^2$, a wire diameter of said plated steel wire is within a range of 4.5 to 7.5 mm, and a tensile strength satisfies a formula: TS≧2192−61×d, wherein, TS represents tensile strength (MPa) and d represents the wire diameter in millimeters.

2. The plated steel wire according to claim 1, wherein the steel wire further comprises in terms of mass %, at least one selected from the group consisting of:

more than 0% and at most 0.5% of Cr,
more than 0% and at most 0.5% of Ni,
more than 0% and at most 0.5% of Co,
more than 0% and at most 0.5% of V,
more than 0% and at most 0.2% of Cu,
more than 0% and at most 0.2% of Mo,
more than 0% and at most 0.2% of W,
more than 0% and at most 0.1% of Nb, and
more than 0% and at most 0.05% of Zr.

3. The plated steel wire according to claim 1, wherein the steel wire further comprises, in terms of mass %, at least one of:

more than 0% and at most 0.5% of Cr,
more than 0% and at most 0.5% of Ni,
more than 0% and at most 0.5% of Co,
more than 0% and at most 0.5% of V,
more than 0% and at most 0.2% of Cu,
more than 0% and at most 0.2% of Mo,
more than 0% and at most 0.2% of W,
more than 0% and at most 0.1% of Nb, and
more than 0% and at most 0.05% of Zr.

* * * * *

UNITED STATES PATENT AND TRADEMARK OFFICE

CERTIFICATE OF CORRECTION

PATENT NO. : 8,105,698 B2
APPLICATION NO. : 12/293067
DATED : January 31, 2012
INVENTOR(S) : Toshiyuki Manabe et al.

It is certified that error appears in the above-identified patent and that said Letters Patent is hereby corrected as shown below:

Col. 23, Line 18

Modify claim 1, at line 3, preceding the word "in", please introduce the following phrase:

"a steel wire, which includes,".

Claim 3 is cancelled.

Signed and Sealed this
Fifth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,105,698 B2
APPLICATION NO. : 12/293067
DATED : January 31, 2012
INVENTOR(S) : Toshiyuki Manabe et al.

It is certified that error appears in the above-identified patent and that said Letters Patent is hereby corrected as shown below:

Delete the title page and substitute therefore the attached title page showing the corrected number of claims in patent.

Col. 23, Line 18
Modify claim 1, at line 3, preceding the word "in", please introduce the following phrase:
"a steel wire, which includes,".

Column 24, delete lines 19-30. Claim 3 is cancelled.

This certificate supersedes the Certificate of Correction issued February 5, 2013.

Signed and Sealed this
Nineteenth Day of March, 2013

Teresa Stanek Rea
*Acting Director of the United States Patent and Trademark Office*

(12) United States Patent
Manabe et al.

(10) Patent No.: US 8,105,698 B2
(45) Date of Patent: Jan. 31, 2012

(54) PLATED STEEL WIRE FOR PARALLEL WIRE STRAND (PWS) WITH EXCELLENT TWIST PROPERTIES

(75) Inventors: Toshiyuki Manabe, Tokyo (JP); Shingo Yamasaki, Tokyo (JP); Seiki Nishida, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 121 days.

(21) Appl. No.: 12/293,067

(22) PCT Filed: Dec. 10, 2007

(86) PCT No.: PCT/JP2007/073770

§ 371 (c)(1), (2), (4) Date: Sep. 15, 2008

(87) PCT Pub. No.: WO2008/093466

PCT Pub. Date: Aug. 7, 2008

(65) Prior Publication Data

US 2010/0239884 A1 Sep. 23, 2010

(30) Foreign Application Priority Data

Jan. 31, 2007 (JP) ..... 2007-022412

(51) Int. Cl.
*B32B 15/04* (2006.01)
*B32B 15/18* (2006.01)
*B32B 15/20* (2006.01)

(52) U.S. Cl. ..... 428/659; 428/364; 428/378; 428/389

(58) Field of Classification Search ..... 428/659, 428/658, 681, 684, 357, 364, 378, 389, 401, 428/213, 215, 219, 220
See application file for complete search history.

(56) References Cited

U.S. PATENT DOCUMENTS

| | | | | |
|---|---|---|---|---|
| 5,211,772 | A | 5/1993 | Ashida et al. | |
| 2006/0048864 | A1 * | 3/2006 | Nagao et al. | 148/320 |
| 2009/0151824 | A1 * | 6/2009 | Yamasaki et al. | 148/598 |
| 2009/0229711 | A1 * | 9/2009 | Yamasaki et al. | 148/505 |

FOREIGN PATENT DOCUMENTS

JP 6-235054 8/1994

(Continued)

OTHER PUBLICATIONS

Machine Translation, Tarui et al., JP 2003-096544, Apr. 2003.*

(Continued)

*Primary Examiner* — Michael Lavilla
(74) *Attorney, Agent, or Firm* — Dorsey & Whitney LLP

(57) ABSTRACT

A plated steel wire for PWS with excellent twist properties contains, in terms of mass %, 0.8 to 1.1% of C, 0.8 to 1.3% of Si, 0.3 to 0.8% of Mn, 0.001 to 0.006% of N, and 0.0004 to 0.0060% of B, where a quantity of solid-solubilized B is at least 0.0002%, also contains either one or both of 0.005 to 0.1% of Al and 0.005 to 0.1% of Ti, and contains as the remainder, Fe and unavoidable impurities, wherein an area fraction of non-pearlite structures in a region from a surface layer down to a depth of 50 μm is not more than 10%, an area fraction of non-pearlite structures within an entire cross-section is not more than 5%, and a surface of the steel wire is galvanized with a plating quantity within a range from 300 to 500 g/m$^2$.

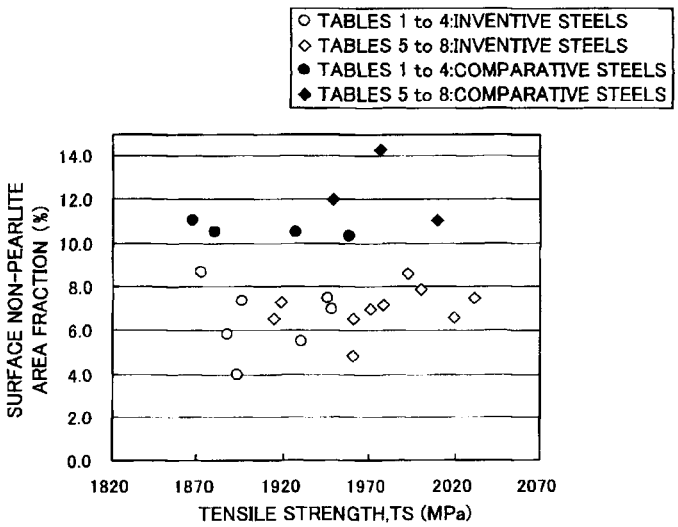

2 Claims, 1 Drawing Sheet